US007798824B2

(12) United States Patent
Fong

(10) Patent No.: US 7,798,824 B2
(45) Date of Patent: Sep. 21, 2010

(54) ADAPTER FOR LINE VOLTAGE TRACK

(75) Inventor: Franklin Phoyeng Fong, Wheeling, IL (US)

(73) Assignee: Juno Manufacturing, Inc., Des Plaines, IL (US)

( * ) Notice: Subject to any disclaimer, the term of this patent is extended or adjusted under 35 U.S.C. 154(b) by 231 days.

(21) Appl. No.: 12/200,657

(22) Filed: Aug. 28, 2008

(65) Prior Publication Data

US 2010/0055947 A1 Mar. 4, 2010

(51) Int. Cl.
*H01R 25/00* (2006.01)

(52) U.S. Cl. ..... 439/116; 439/110; 362/147; 362/391

(58) Field of Classification Search ..... 439/116, 439/121, 110, 111, 112, 117, 118, 119, 259, 439/263, 266, 207; 362/147, 226, 238, 239, 362/249, 250, 391, 373, 404, 294, 269, 407, 362/427

See application file for complete search history.

(56) References Cited

U.S. PATENT DOCUMENTS

| | | | | |
|---|---|---|---|---|
| 4,190,309 | A | 2/1980 | Glass | 339/21 R |
| 4,676,567 | A | 6/1987 | Mouchi | 439/207 |
| 6,244,733 | B1 | 6/2001 | Fong et al. | 362/391 |
| 6,676,281 | B2 | 1/2004 | Bray et al. | 362/391 |
| 6,716,042 | B2 * | 4/2004 | Lin | 439/110 |
| 7,140,888 | B1 | 11/2006 | Chan | 439/119 |
| 7,172,332 | B2 | 2/2007 | Mobarak et al. | 362/649 |
| 7,503,778 | B2 * | 3/2009 | Lehman et al. | 439/110 |
| 2002/0137374 | A1 * | 9/2002 | O'Rourke et al. | 439/121 |
| 2007/0153550 | A1 | 7/2007 | Lehman et al. | 362/648 |
| 2008/0123354 | A1 | 5/2008 | Caldani | 362/418 |

OTHER PUBLICATIONS

Halo Spec Sheets for LF10620, LA10620, and L10620, http://www.cooperlighting.com/specfiles/pdf/Halo/ADV050016.pdf, Jan. 25, 2007 (2 pages).

Halo Architectural Flexible Track Installation Instructions LF601, http://www.cooperlighting.com/specfiles/instGuides/703214%20inst%20sheet.pdf, Date Unknown (2 pages).

Halo Buyer's Guide for Synchro PAR20 Lampholder, Synchro PAR30 Lampholder, and Synchro PAR38 Lampholder, http://www.cooperlighting.com/specfiles/productinfopdf/SYN_1_06_20_30_38.pdf, Date Unknown (1 page).

(Continued)

*Primary Examiner*—Edwin A. Leon

(57) ABSTRACT

An adapter for an electrical line voltage track system includes a housing having a first end adapted for mounting to an electrical source or an electrical fixture, and a second end adapted for mounting to a line voltage track. The housing includes a housing cover coupled to a housing body. The housing cover is movable relative to the housing body between a closed position and an open position. A supporting sleeve is movably coupled to the housing, and a plurality of electrical contacts, including a fixed contact and a movable contact, are also coupled to the housing. The movable contact is movable, relative to the housing, between an engaged position and a disengaged position. In the engaged position, the movable contact causes electrical contact with the line voltage track. In the disengaged position, electrical contact is removed.

20 Claims, 7 Drawing Sheets

OTHER PUBLICATIONS

Halo Installation Instructions for LF106, LA106, and L106 Series, http://www.cooperlighting.com/specfiles/InstGuides/962005115757_LF106_Inst._s.pdf, Date Unknown (2 pages).
Halo Product Detail for Synchro 106-20, http://www.halotg.com/common/brands.cfm?pg=Detailed&brand=Halo&category=Track%20Lighting%3A%20Architectural%20Track%3A%%20Synchro&id=13824, Date Unknown (2 pages).
WAC Lighting, HMI-816 Product Detail Sheet, http://www.waclighting.com/USA/products/?categoryid=22&productid=158, Date Unknown (1 page).

* cited by examiner

ADAPTER FOR LINE VOLTAGE TRACK

FIELD OF THE INVENTION

This invention is directed generally to electrical track lighting systems, and, more particularly, to an adapter for coupling an electrical fixture or a power feed to a line voltage track.

BACKGROUND OF THE INVENTION

Track lighting systems are accepted electrical systems both in commercial and residential applications. Well recognized advantages of track lighting include ease of placement and positioning of lights. For example, the position of the lights can be easily changed to accommodate changes in display of merchandise in commercial applications and rearrangement of furniture in residential applications.

Light fixtures or power feeds are generally mounted to a track via an adapter. Typically, the light fixture or the power feed is mounted to one end of the adapter and the track is mounted to another end of the adapter. Electrical contacts mounted to the housing of the adapter are positioned in engagement with conductors of the track to provide an electrical path from/to an electrical source (e.g., to provide electrical current from a power source to a light via the track conductors). However, current adapters are plagued by many problems.

For example, one problem associated with some adapters is that they are difficult to install on a track. This type of adapter generally requires the use of tools (e.g., screwdrivers, pliers, etc.) and/or requires the assembly of several separate components. To install the adapter, a service person may be required to simultaneously hold several components of the adapter and at least one tool. For example, the service person may have to perform several tasks generally simultaneously: hold a bottom housing portion with one hand; hold a top housing portion with another hand; position the bottom housing portion and the top housing portion correctly around the track; use a screwdriver to secure in place the top housing portion to the bottom housing portion via a locking screw; and maintain balance on a ladder. Likely, the service person may require several attempts before successfully installing the adapter to the track. Dropping components or losing balance on the ladder are common scenarios that can result in a frustrating and time-consuming experience when installing the adapter.

In another example, other problems associated with some adapters is that they lack reliable and consistent electrical contacts. Furthermore, the electrical contacts may present a risk of electrocution and difficulty during installation.

The electrical contacts of this type of adapters are mounted in a fixed position relative to the housing of the adapter. Because the electrical contacts are fixed contacts, they have an inherently small tolerance for error. If an error is made during manufacturing, the fixed contact may fail to properly engage the track conductor. Furthermore, changing the position of the adapter can improperly bend or otherwise damage the fixed contact. As such, the fixed contact may fail over time to properly engage the track conductor, by intermittently or completely failing to conduct electricity.

Moreover, because the electrical contact is fixed in place, it will generally be positioned in physical contact with the track conductor as soon as the adapter is mounted to the track. In other words, there is generally no gap between the electrical contact and the conductor when the adapter has been mounted to the track. As such, if electrical power is not disconnected when the adapter is mounted to the track, the service person may be electrocuted. Although installation protocol generally requires the service person to disconnect live electrical contact during installation, this is not always the case. In practice, for various reasons, the service person may forget, ignore, or inadvertently fail to disconnect live power.

The installation of the adapter may also require greater than necessary accuracy when positioning the adapter in place on the track. Specifically, the service person must take great care to position the adapter on the track such that the electrical contact is in its exact engaged position. The lack of a physical tolerance, such as a gap between the electrical contact and the track conductor, can create an unnecessarily difficult installation experience.

What is needed, therefore, is an adapter that addresses the above-stated and other problems.

SUMMARY OF THE INVENTION

In an implementation of the present invention, an adapter for an electrical line voltage track system includes a housing having a first end adapted for mounting to one of an electrical source and an electrical fixture, and a second end adapted for mounting to a line voltage track. The housing includes a housing cover coupled to a housing body, the housing cover being movable relative to the housing body between a closed position and an open position. A supporting sleeve is movably coupled to the housing, and a plurality of electrical contacts, including a fixed contact and a movable contact, are also coupled to the housing. The movable contact is movable, relative to the housing, between an engaged position and a disengaged position. In the engaged position, the movable contact causes electrical contact with the line voltage track. In the disengaged position, electrical contact is removed.

In an alternative implementation of the present invention, an adapter for an electrical line voltage track system includes a housing, a sleeve, and a movable contact. The housing has a cover pivotable between a closed position and an open position, and forms a closed track hole when the cover is in the closed position and an open track hole for receiving a line voltage track when the cover is in the open position. The sleeve is coupled to the housing and is movable in an axial direction relative to the housing when in an unsecured position. The sleeve is fixed relative to the housing in a secured position. The movable contact, which is movable relative to both the housing and the sleeve, is mounted to the sleeve for insertion in a track cavity, and is biased by a contact spring in the axial direction. The movable contact has an electrically engaged position and an electrically disengaged position, the electrically engaged position being achieved in the secured position of the sleeve.

In another alternative implementation of the present invention, a line voltage track system includes a line voltage track and an electrical adapter. The line voltage track has a live track cavity and a neutral track cavity. A live conductor is included in the live track cavity and a neutral contact is included in the neutral track cavity. The electrical adapter is adapted for mounting an electrical fixture to the line voltage track, and includes a housing, a sleeve, and a movable contact. The housing has a track hole for receiving the line voltage track, and an end adapted for mounting to the electrical fixture. The sleeve is movably coupled to the housing for securing the electrical adapter to the line voltage track. The movable contact electrically couples the electrical fixture to the live conductor, and is biased by a spring against the live conductor of the line voltage track when the movable contact is in an electrically engaged position. The electrically engaged position is achieved by axial displacement of the sleeve towards the line voltage track relative to the sleeve.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
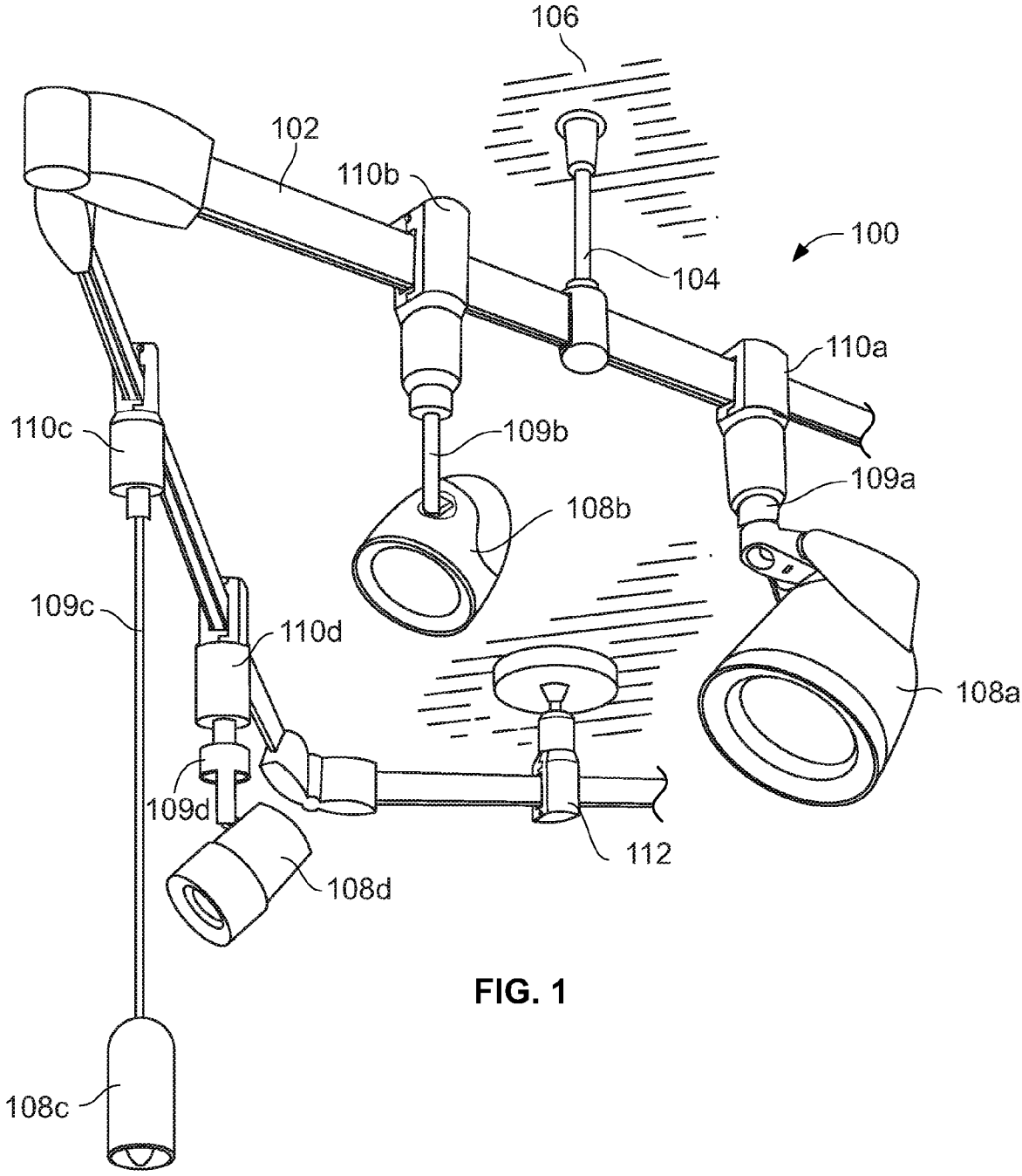
FIG. 1 is a perspective view of a line voltage track lighting system, according to one embodiment.

Referring to FIG. 1, a line voltage track lighting system 100 includes a line voltage track 102 that is supported via a mount 104 to a ceiling 106. The track 102 is arranged in a non-linear form and includes a plurality of bends to follow a desired ceiling contour.

A plurality of light fixtures 108*a*-108*d* having corresponding fixture supports 109*a*-109*d* are mounted to the track 102 via corresponding fixture adapters 110*a*-110*d*. The fixture adapters 110*a*-110*d* are generally similar, if not identical, but may vary in size and shape. A more detailed description of the fixture adapters 110*a*-110*d* (with reference to a single adapter 110) is provided below in more detail.

A feed adapter 112 is also mounted to the track 102, physically coupling the track 102 to the ceiling 106 and electrically coupling the track 102 to an electrical source. The feed adapter 112 is generally similar to the adapters 110*a*-110*d*, but some of its features are modified to account for a reversal of arrangement in its electrical contacts. Changes between the feed adapter 112 and the adapters 110*a*-110*d* are described below in more detail.

Figure 2:
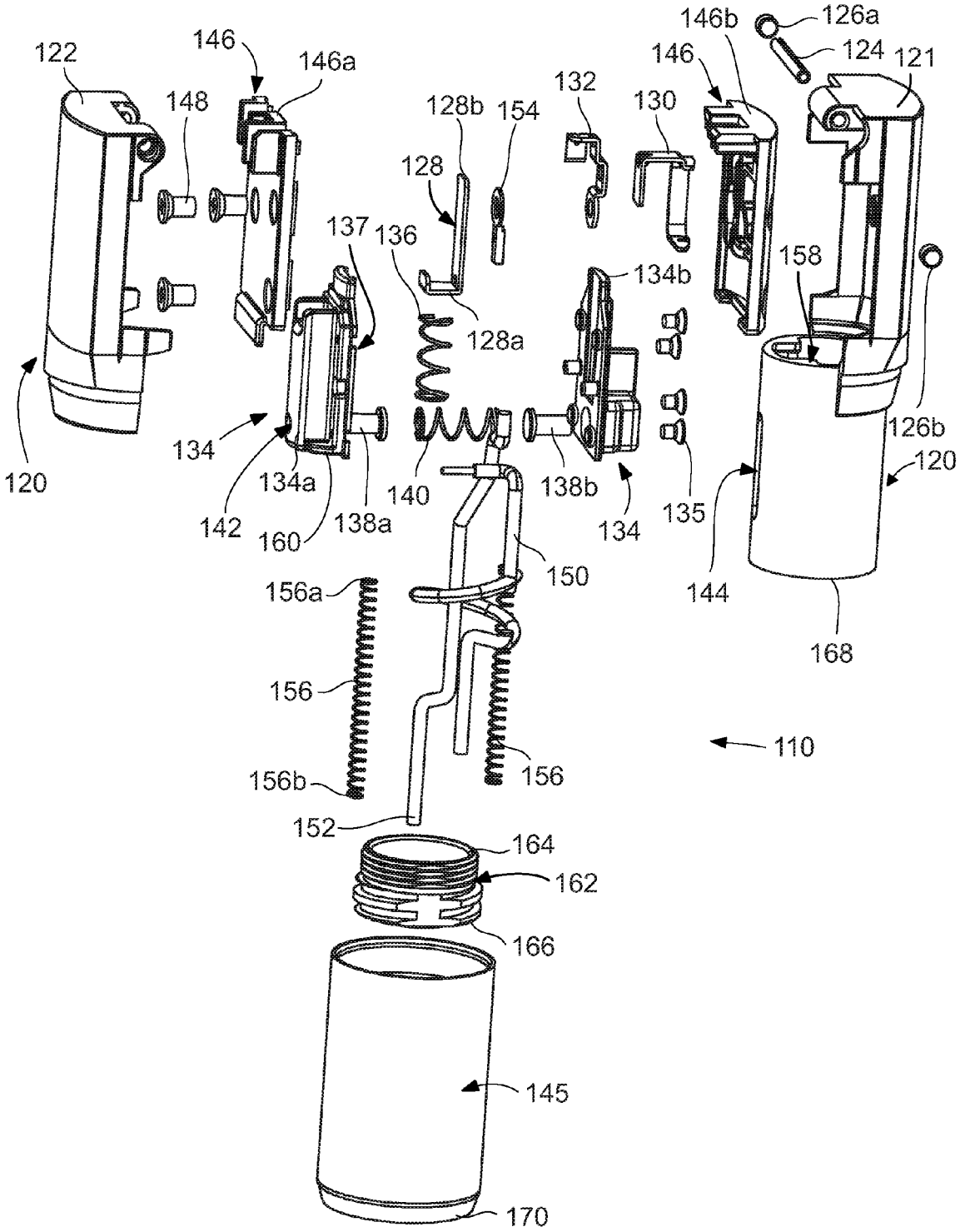
FIG. 2 is an exploded perspective view of an adapter included in the line voltage track lighting.

Referring to FIG. 2, the adapter 110 includes a housing 120 having a housing body 121 and a housing cover 122. The housing cover 122 is pivotably attached to the housing body 121 via a pin 124. One of a pair of end caps 126*a*, 126*b* is mounted on each end of the pin 124. In general, according to this exemplary embodiment, all the parts of the adapter 110 are secured together as a unit.

Internally, the housing 120 encloses a plurality of electrical contacts, including a live contact 128, a neutral contact 130, and a ground contact 132. The live contact 128 is mounted in a retaining compartment 134, which includes a first retaining section 134*a* and a second retaining section 134*b*. The first and second retaining sections 134*a*, 134*b* are mounted to each other via a plurality of mounting screws 135.

The live contact 128 is biased by a contact spring 136, which is positioned inside a spring cavity 137 of the retaining compartment 134. Specifically, a lower end 128*a* of the live contact 128 is in contact with the contact spring 136, while an upper end 128*b* of the live contact 128 protrudes externally from the retaining compartment 134. In this embodiment, the lower end 128*a* of the live contact 128 is generally perpendicular to the upper end 128*b*.

The retaining compartment 134 includes a first guide pin 138*a* and a second guide pin 138*b*, which are biased away from each other via a guide pin spring 140. When assembled, each of the guide pins 138*a*, 138*b*, protrudes through a respective guide hole 142 and through a respective housing slit 144 to contact an internal wall of a sleeve 145.

The adapter 110 also includes a retaining housing 146 having a first contact retaining housing 146*a* and a second contact retaining housing 146*b*. The retaining housing 146 is mounted to the housing body 120 via a plurality of mounting screws 148. The neutral contact 130 and the ground contact 132 are both fixedly mounted in the retaining housing 146.

The live contact 128 is attached to a live lead wire 150, which is internally inserted through the sleeve 145. The neutral contact 130 is attached to a neutral lead wire 152, which is also internally inserted through the sleeve 145. A neutral coupler 154 connects the neutral contact 130 to the neutral lead wire 152.

First and second sleeve springs, collectively 156, are positioned in a housing body cavity 158. A top end 156*a* of each spring is positioned in contact with the housing body 121, and a bottom end 156*b* of each spring is positioned in contact with a spring surface 160 of the retaining compartment 134. The sleeve springs 156 exert a biasing force on the retaining compartment 134 to move the retaining compartment 134 axially in a direction away from the housing 120. In turn, the retaining compartment 134 contacts and forces the sleeve 145 to move axially in a direction away from the housing 120.

The adapter 110 further includes a connector 162 which has a top threaded end 164 and a bottom threaded end 166. The top threaded end 164 is adapted to couple with a housing matching thread of the housing body 121. The housing matching thread of the housing body 121 (not shown) is generally located internally near a lower end 168 of the housing body 121. The bottom threaded end 166 of the connector 162 is adapted to couple with a sleeve matching thread of the sleeve 145. The sleeve matching thread of the sleeve 145 is generally located internally near a lower end 170 of the sleeve 145. In this embodiment, the top threaded end 164 has a finer thread than the bottom threaded end 166. The adapter 110 further includes an internal threaded area 172 (shown in FIGS. 3A-4B) for coupling the housing 120 to a corresponding fixture support 109*a*-109*d*.

In general, the connector 162 is fixed to the housing body 121 during assembly. Although the connector 162 can be removed from the housing body 121 (e.g., by unscrewing the connector 162), the connector 162 typically remains fixed to the housing body 121 throughout installation of the adapter 110 and thereafter. In contrast, the sleeve 145 is coupled to the connector 162 during installation of the adapter 110 and may be removed when the adapter 110 requires, for example, further service or a change in position.

Referring to FIGS. 3A-4B, the adapter 110 is illustrated installed to the track 102, with the housing cover 122 in a closed position. The track 102 includes a live conductor 200 and a neutral conductor 202 positioned in respective insulators 204, 206. The track 102 has a general H (polarized) configuration and the insulators 204, 206 have a general U configuration. The track 102 protrudes through the adapter 110 from a track hole 208 that is formed in the adapter 110.

The configuration of the track 102 is also generally referred as a top mounting track configuration. Although the described embodiments pertain to the top mounting track configuration, the adapter of the present invention may be configured for other track configurations (e.g., a side mounting track configuration).

Figure 3B:
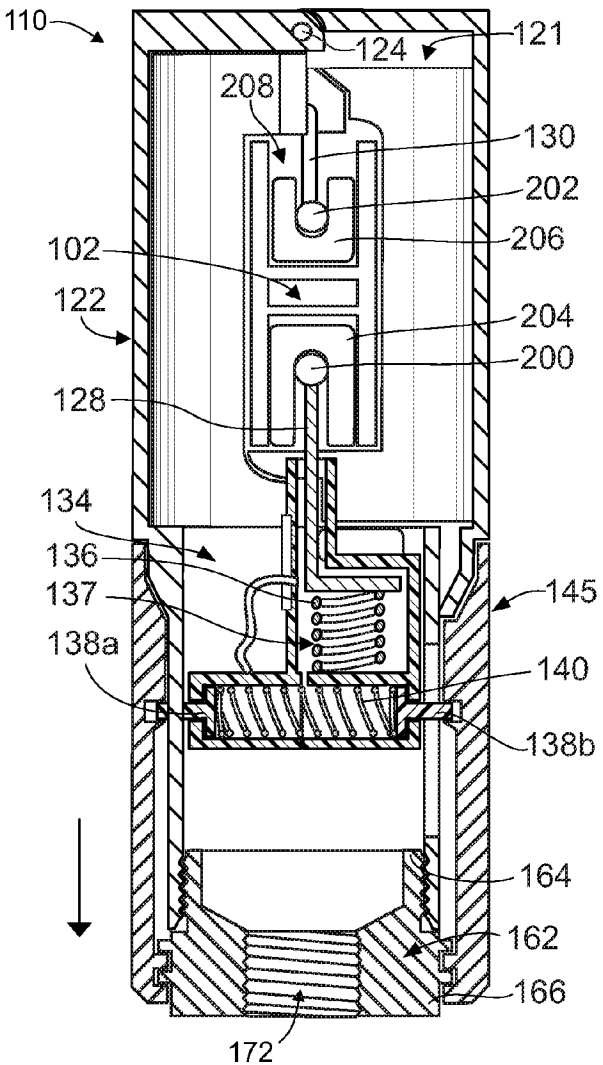
FIG. 3B illustrates the adapter of FIG. 3*b* in an engaged position of the live contact.
Figure 3A:
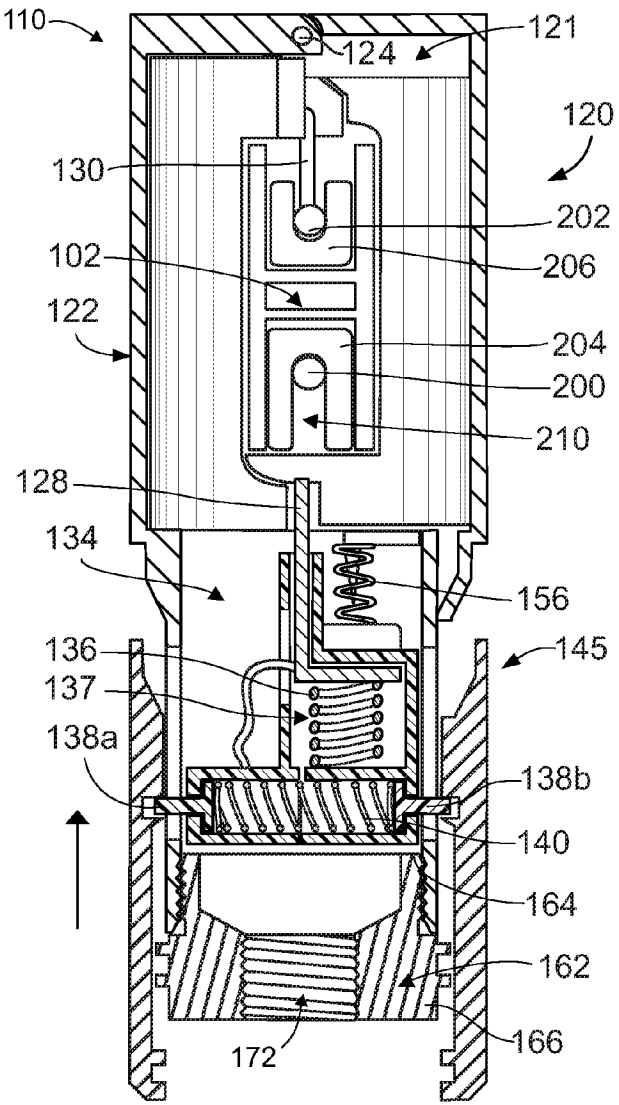
FIG. 3A is a side cross-sectional view illustrating the adapter in assembled form and mounted to a track of the line voltage track lighting system, the adapter being in a disengaged position of a live contact.
Figure 4B:
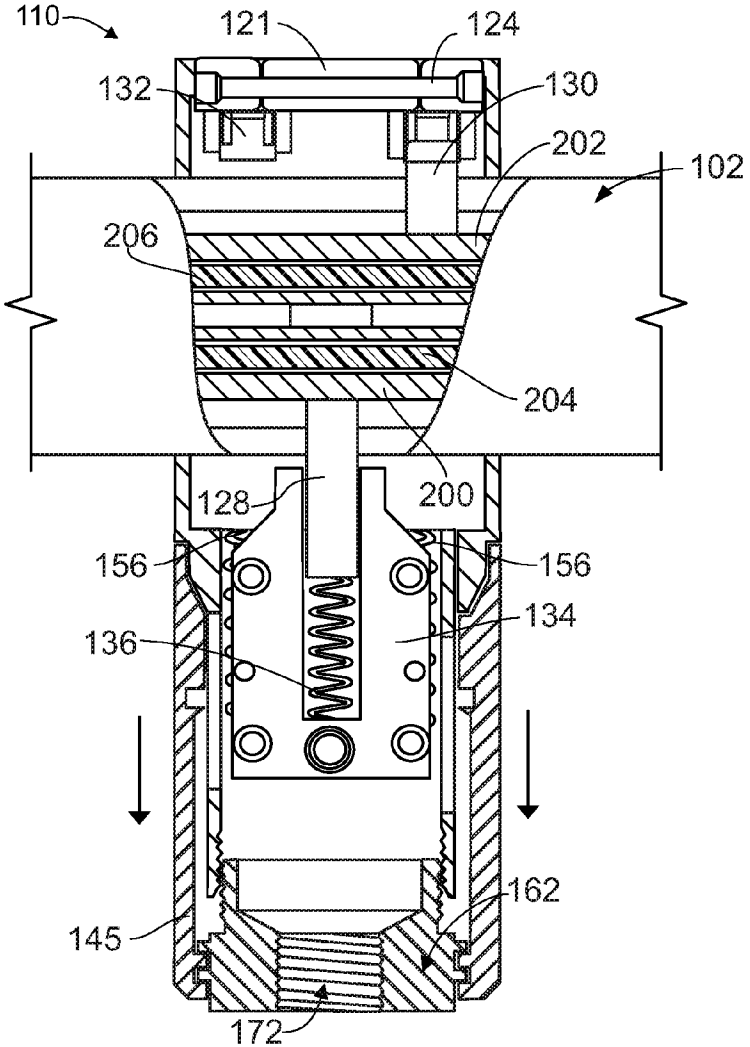
FIG. 4B is a front cross-sectional view of the adapter of FIG. 3*b*.
Figure 4A:
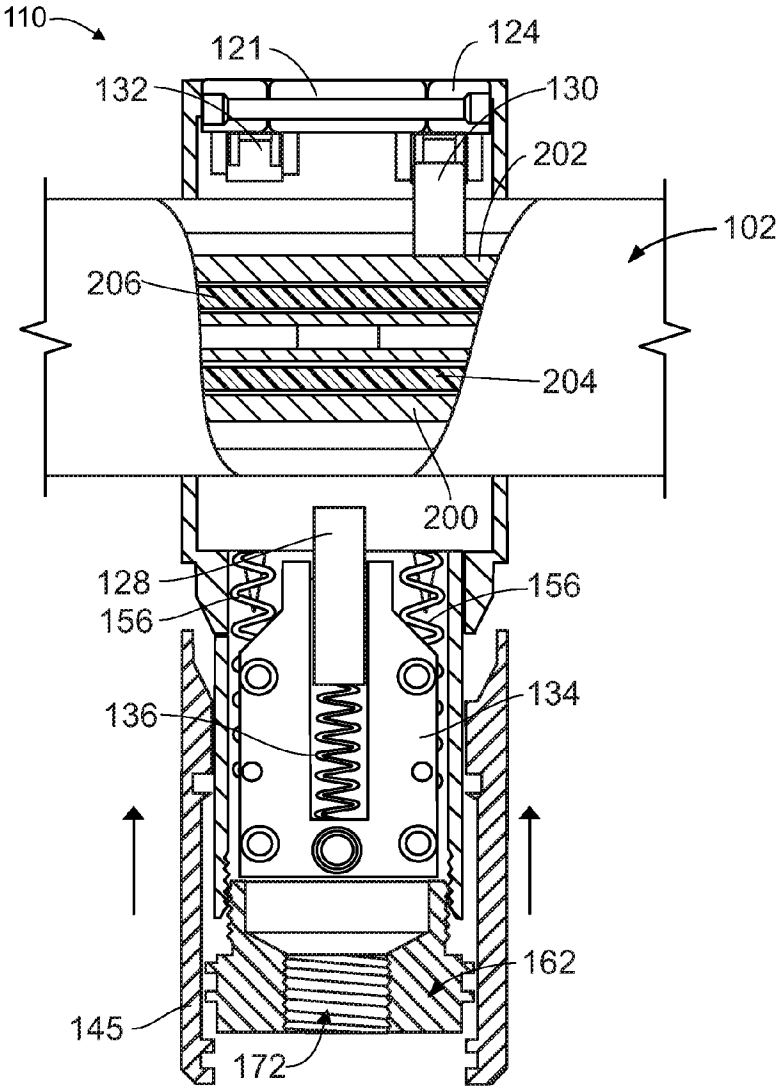
FIG. 4A is a front cross-sectional view of the adapter of FIG. 3*a*.

When the housing cover 122 is in the closed position, the adapter 110 has two general positions including a disengaged position (shown in FIGS. 3A and 4B) and an engaged position (shown in FIGS. 3B and 4B). In the disengaged position, the live contact 128 is separated from the live conductor 200 by a gap 210. As such, electrical contact between the adapter 110 and the track 102 is prevented.

To position the live contact 128 in the engaged position, and thereby allow electrical contact between the adapter 110 and the track 102, the sleeve 145 is moved upwards (in an axial direction towards the housing 120). Generally simultaneously, the sleeve 145 is also rotated to threadedly engage the sleeve 145 to the connector 162 in a locked position. The movement of the sleeve 145 relative to the housing 120 raises the live contact 128 towards the live conductor 200, eventually removing the gap 210 when the live contact 128 makes contact with the live conductor 200.

The sleeve biasing force caused by the sleeve springs 156 helps reduce some aspects of normal wear-and-tear associated with the sleeve-to-housing coupling by providing an additional pressure when coupling the sleeve 145 to the housing 120. The sleeve biasing force also helps to generally immediately remove contact between the live contact 128 and the live conductor 200 when removing or changing the position of the adapter 110.

The contact biasing force caused by the contact spring 136 helps reduce some aspects of normal wear-and-tear associated with the contact-to-conductor engagement by providing an additional pressure when engaging the live contact 128 to the live conductor 200. As such, electrical contact may persist even if bending or other physical damage may occur to the live contact 128 or the live conductor 200.

Figure 5A:
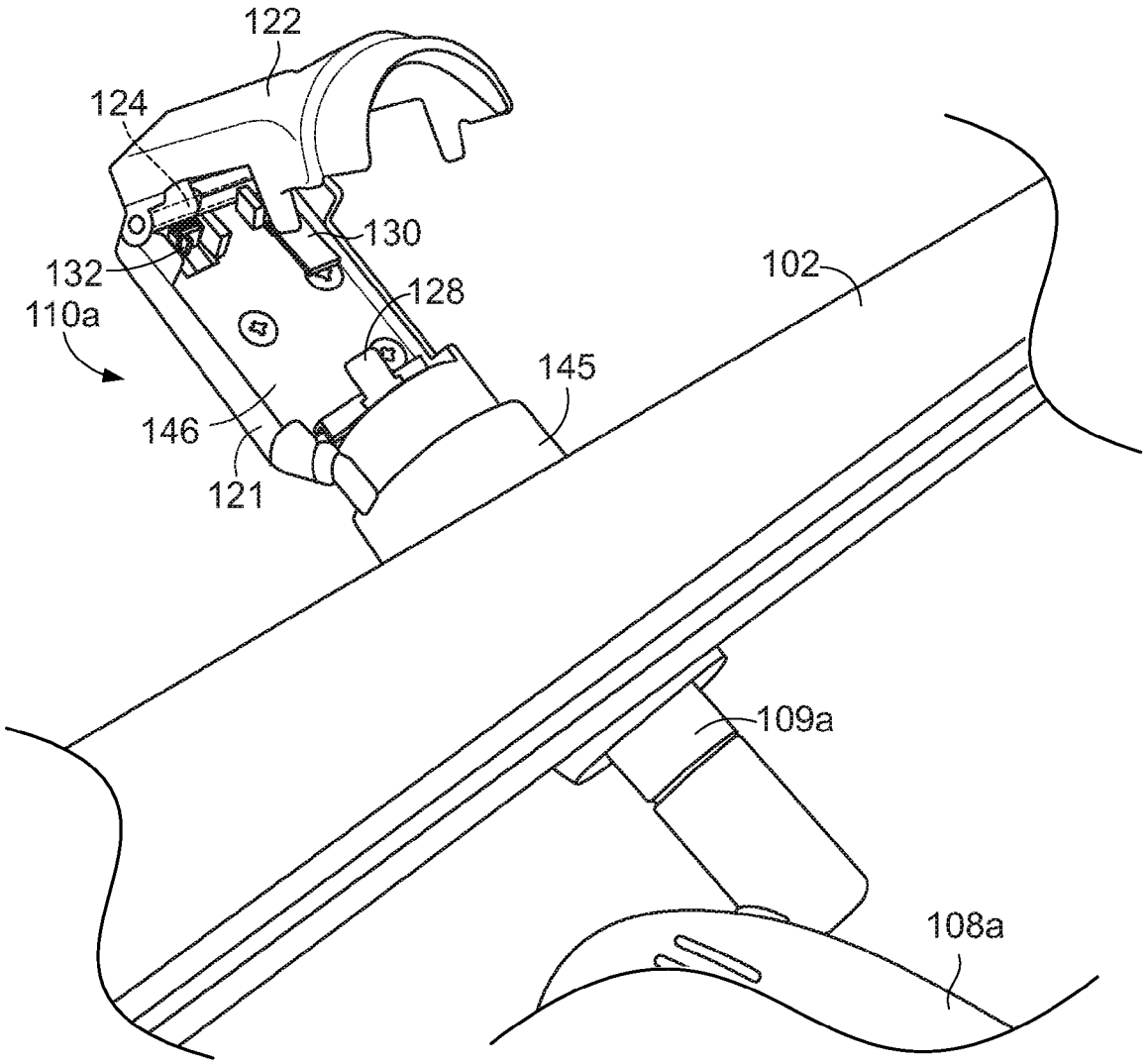
FIG. 5A is a perspective view of the adapter illustrating a housing cover in an open position before mounting to the track.
Figure 5B:
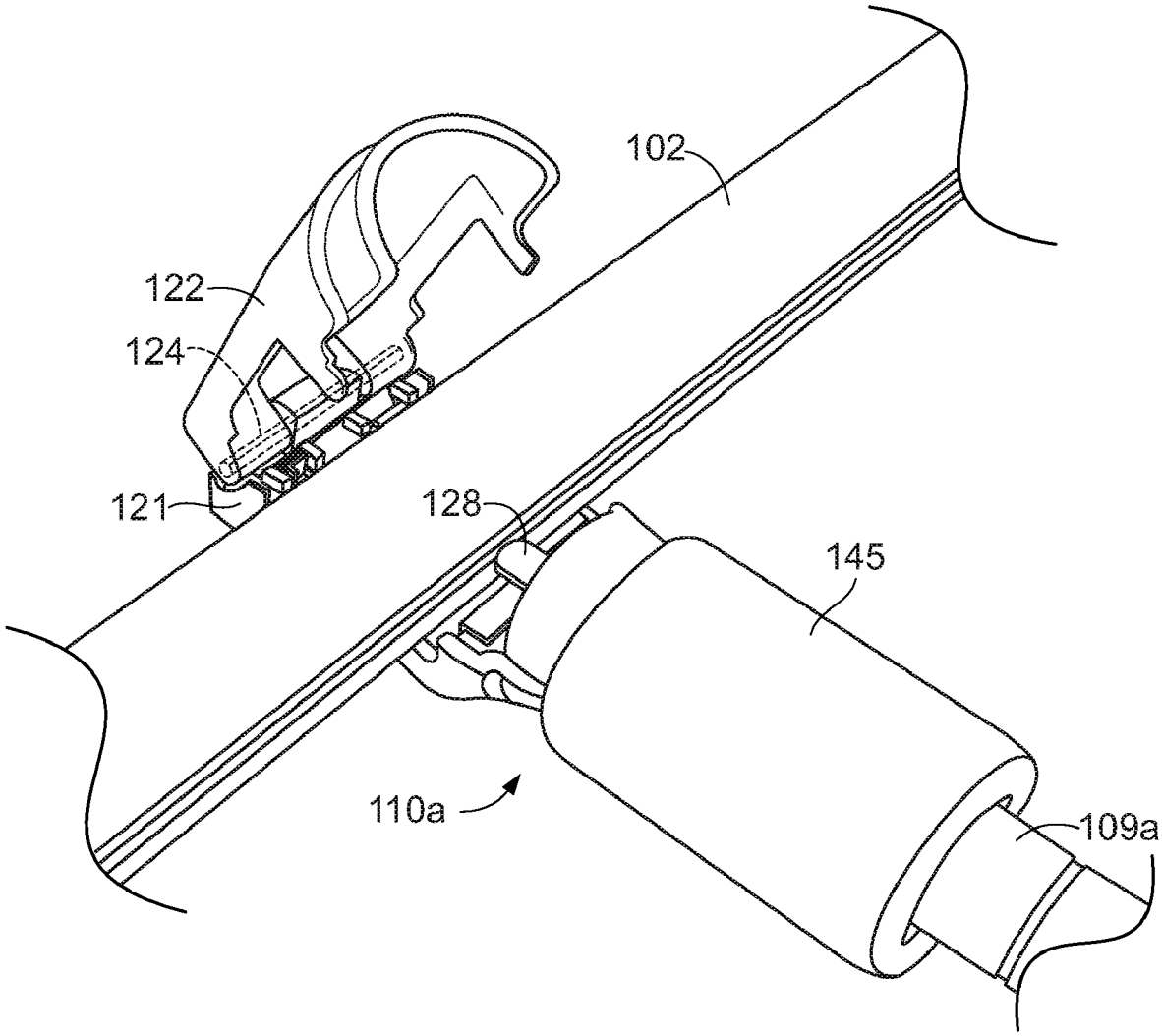
FIG. 5B is a perspective view of the adapter illustrating the housing cover in the open position, after mounting to the track, the live contact being in a disengaged position.
Figure 5C:
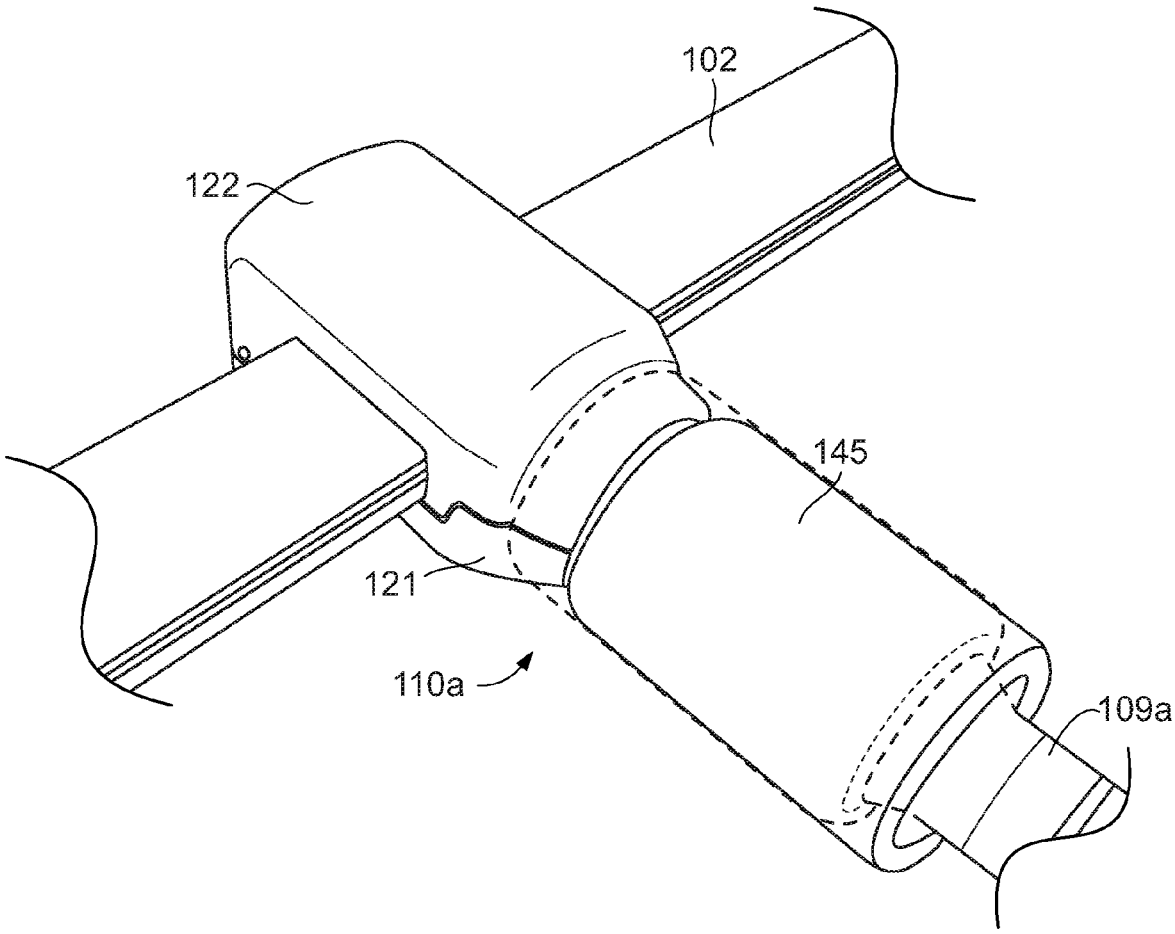
FIG. 5C is a perspective view of the adapter illustrating the housing cover in a closed position and the sleeve movable between the disengaged position to the engaged position of the live contact.

Referring to FIGS. 5A-5C, the general installation of the adapter 110*a* to the track 102 includes an initial position (shown in FIG. 5A) in which the adapter 110*a* is separate from the track 102. In this initial position, the housing cover 122 is in the open position.

The adapter 110*a* is, then, placed on the track 102 in a partially mounted position (as shown in FIG. 5B). In the illustrated position, the live contact 128 does not engage, yet, the live conductor 200 (not shown). The housing cover 122 is still in the open position.

The adapter 110*a* is placed in a fully mounted position (shown in FIG. 5C) when the housing cover 122 is positioned in its closed position. Specifically, the closed position of the housing cover 122 is achieved by pivoting the housing cover 122 in a clockwise direction so that its lower end (opposite the end hinged to the housing body 121) is now in contact with the housing body 121. To place the live contact in engagement with the live conductor 200, the sleeve 145 is moved axially towards the track 102 as it is being rotated to threadedly engage the connector 162. The threaded engagement between the sleeve 145 and the connector 162 secures the sleeve 145 over the housing 120 such that the housing cover 122 cannot move from the closed position to the open position. More specifically, an upper portion of the sleeve 145 overlaps (and locks) the lower portion of the housing cover 122 to prevent movement of the housing cover 122 relative to the housing body 121.

In alternative embodiments, the feed adapter 112 (FIG. 1) is generally similar to the adapter 110 described above, except that the live contact 128 and the neutral contact 130 are reversed. Because the feed adapter 112 is mounted on the track 102 in a position rotated 180 degrees relative to the adapter 110, the live contact 128 becomes the neutral contact 130 and the neutral contact 130 becomes the live contact 128. For example, in one exemplary embodiment the reversal of the contacts can be made by generally coupling the live contact 128 to the neutral lead wire 152 and the neutral contact 130 to the live lead wire 150.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An adapter for an electrical line voltage track system, the adapter comprising:

a housing having a first end adapted for mounting to one of an electrical source and an electrical fixture and a second end adapted for mounting to a line voltage track, the housing including a housing cover coupled to a housing body and movable relative to the housing body between a closed position and an open position;

a supporting sleeve movably coupled to the housing; and a plurality of electrical contacts enclosed in the housing and including a fixed contact and a movable contact, the movable contact being movable relative to the housing between an engaged position and a disengaged position, the movable contact causing electrical contact with the line voltage track in the engaged position, the electrical contact being removed when the movable contact is in the disengaged position.

2. The adapter of claim 1, wherein the movable contact is a live contact.

3. The adapter of claim 1, wherein all parts of the adapter, including the housing, the supporting sleeve, and the plurality of electrical contacts, are secured together as a unit.

4. The adapter of claim 1, wherein both the fixed contact and the movable contact are mounted to the housing.

5. The adapter of claim 1, further comprising at least one sleeve spring mounted between the supporting sleeve and the housing for causing a biasing force directing the supporting sleeve away from the housing.

6. The adapter of claim 1, further comprising at least one contact spring mounted between the movable contact and a retaining compartment for causing a biasing force directing the movable contact away from the supporting sleeve and toward the housing, the retaining compartment being located within the housing.

7. The adapter of claim 1, further comprising a threaded connector coupled to the housing, the threaded connector receiving a mating threaded end of the supporting sleeve for securing the supporting sleeve to the housing in a secured position of the supporting sleeve.

8. The adapter of claim 1, wherein the housing cover is hingedly coupled to the housing body.

9. The adapter of claim 1, further comprising a lead wire coupled to each of the fixed contact and the movable contact, the lead wire passing internally through the supporting sleeve.

10. The adapter of claim 1, wherein the fixed contact and the movable contact are configured to be received in a top mounting track configuration.

11. An adapter for an electrical line voltage track system, the adapter comprising:

a housing having a cover pivotable between a closed position and an open position, the housing forming a closed track hole when the cover is in the closed position, the housing forming an open track hole for receiving a line voltage track when the cover is in the open position;

a sleeve coupled to the housing, the sleeve being movable in an axial direction relative to the housing when in an unsecured position, the sleeve being fixed relative to the housing in a secured position; and a movable contact mounted to the sleeve for insertion in a track cavity, the movable contact being biased by a contact spring in the axial direction and movable relative to both the housing and the sleeve, the movable contact having an electrically engaged position and an electrically disengaged position, the electrically engaged position being achieved in the secured position of the sleeve.

12. The adapter of claim 11, further comprising a threaded connector coupled to the housing, the secured position of the sleeve being achieved by generally simultaneously moving the sleeve toward the housing in the axial direction and rotating the sleeve to threadedly engage a threaded end of the sleeve to the threaded connector.

13. The adapter of claim 11, further comprising at least one sleeve spring for biasing the sleeve away from the housing.

14. The adapter of claim 11, wherein the movable contact is a live contact mounted to a retaining compartment inside the housing, the movable contact being electrically coupled to a live lead wire enclosed within the sleeve.

15. The adapter of claim 11, wherein the movable contact is a neutral contact mounted to a retaining compartment inside the housing, the movable contact being electrically coupled to a neutral lead wire enclosed within the sleeve.

16. A line voltage track system comprising:

a line voltage track having a live track cavity and a neutral track cavity, the line voltage track including a live conductor in the live track cavity and a neutral conductor in the neutral track cavity;

an electrical adapter for mounting an electrical fixture to the line voltage track, the electrical adapter including a housing having a track hole for receiving the line voltage track, the housing having an end adapted for mounting to the electrical fixture, a sleeve movably coupled to the housing for securing the electrical adapter to the line voltage track, and a movable contact for electrically coupling the electrical fixture to the live conductor, the movable contact being biased by a spring against the live conductor of the line voltage track when the movable contact is in an electrically engaged position, the electrically engaged position being achieved by axial displacement of the sleeve towards the line voltage track relative to the sleeve.

17. The line voltage track system of claim 16, further comprising another electrical adapter for mounting a power feed to the line voltage track.

18. The line voltage track system of claim 17, wherein the another electrical adapter includes another movable contact being biased by another spring against the neutral conductor of the line voltage track.

19. The line voltage track system of claim 16, wherein the electrical adapter further includes a pair of sleeve springs for biasing the sleeve relative to the housing away from the line voltage track.

20. The line voltage track system of claim 16, wherein the housing includes a cover pivotable between an open position and a closed position, the housing being mountable to the line voltage track in the open position, the movable contact being separated from the live conductor of the line voltage track by a gap in both the open position and the closed position.

* * * * *